US006341732B1

(12) United States Patent
Martin et al.

(10) Patent No.: US 6,341,732 B1
(45) Date of Patent: Jan. 29, 2002

(54) METHOD AND APPARATUS FOR MAINTAINING CONTROL OF LIQUID FLOW IN A VIBRATORY ATOMIZING DEVICE

(75) Inventors: Frederick H. Martin, Racine; Thomas A. Helf, Waukesha; David J. Schram, Racine; Maryann Jashinske, Racine; David A. Tomkins, Racine; Edward J. Martens, III, Racine, all of WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 25 days.

(21) Appl. No.: 09/596,714

(22) Filed: Jun. 19, 2000

(51) Int. Cl.[7] ..... B05B 17/04

(52) U.S. Cl. ..... 239/4; 239/101; 239/102.2; 239/104; 239/124; 239/302; 239/548; 239/596; 128/200.16

(58) Field of Search ..... 239/101, 102.1, 239/102.2, 4, 104, 106, 110, 548, 567, 596, 601, 302, 338, 124; 347/1, 44, 22, 34, 47, 49, 68, 70, 74, 75, 94; 128/200.14, 200.16

(56) References Cited

U.S. PATENT DOCUMENTS 4,413,268 A 11/1983 Bentin
4,528,577 A 7/1985 Cloutier et al.
4,533,082 A 8/1985 Maehara et al.
4,542,389 A 9/1985 Allen
4,550,326 A 10/1985 Allen et al.
4,578,687 A 3/1986 Cloutier et al.
4,605,167 A * 8/1986 Maehara ..... 239/102.2
4,632,311 A 12/1986 Nakane et al.
4,702,418 A * 10/1987 Carter et al. ..... 239/4 X
4,793,339 A 12/1988 Matsumoto et al.
5,152,456 A * 10/1992 Ross et al. ..... 239/102.2
5,164,740 A 11/1992 Ivri
5,299,739 A * 4/1994 Takahashi et al. ..... 239/102.2
5,355,158 A 10/1994 Inada et al.
5,518,179 A * 5/1996 Humberstone et al. .. 239/102.2
5,815,177 A 9/1998 Sasaki
5,823,428 A * 10/1998 Humberstone et al. ..... 239/4 X
5,938,117 A * 8/1999 Ivri ..... 239/102.2 X

* cited by examiner

*Primary Examiner*—Steven J. Ganey

(57) ABSTRACT

Liquid to be atomized is supplied from a wick to the underside of a vibrating orifice plate which pumps the liquid up through atomizing orifices in the plate and ejects the liquid from is upper side; and liquid which is pumped up through the orifices in an elevated region of the plate, but which has not been ejected, is directed back down through larger openings in a lower region of the plate. The liquid also flows back onto the wick which places the liquid in capillary communication along the underside of the plate with the atomizing orifices for reputing and ejection.

24 Claims, 1 Drawing Sheet

METHOD AND APPARATUS FOR MAINTAINING CONTROL OF LIQUID FLOW IN A VIBRATORY ATOMIZING DEVICE

BACKGROUND OF THE INVENTION

1. Field of the Invention

This invention relates to the atomization of liquids by means of a vibrating perforated member, such as a membrane or an orifice plate. More particularly the invention concerns the control of liquid flow through such orifice plate to ensure a stable and continuous atomizing operation.

2. Description of the Related Art

Vibratory atomizing devices are well known, as seen for example, in U.S. Pat. No. 5,152,456, U.S. Pat. No. 5,164,740, U.S. Pat. No. 4,632,3171 and U.S. Pat. No. 4,533,082. In general, such devices incorporate a thin plate having at least one small orifice extending therethrough and which is attached to and vibrated by a piezoelectric actuation element. An alternating voltage applied to the piezoelectric actuation element causes it to expand and contract; and this expansion and contraction produces up and down vibratory movement of the orifice plate. A liquid supply, such as a wick, transports liquid to be atomized from a reservoir to the one side of the plate so that the liquid contacts the plate in the region of its perforations. The up and down vibratory movement of the plate pumps the liquid through the orifices and ejects the liquid as aerosolized liquid particles from its upper surface.

One particularly efficient piezoelectric atomizing arrangement uses an annularly shaped piezoelectric actuation element having a central opening and an orifice plate that covers the central opening on the piezoelectric element. The plate extends across and somewhat beyond the central opening of the piezoelectric actuation element; and it is fixed to the element where it overlaps the region of the element around its central opening. When an alternating voltage is applied to the upper and lower sides of the piezoelectric actuation element, the element expands and contracts in a radial direction. This radial expansion and contraction increases and decreases the diameter of its central opening, which in turn forces the orifice plate to flex and bend so that its central region, which contains one or more orifices, moves up and down in a vibratory manner.

Preferably, the orifices are formed in the central region of the plate and this region is domed slightly.

A problem occurs in these piezoelectric vibratory atomizer devices in that not all of the liquid which is pumped through the perforations in the orifice plate becomes ejected from the upper surface of the plate. The liquid which is not ejected or ejected liquid which falls back on the plate remains on the upper surface of the plate and interferes with the atomizing action. Further, in the situation where the orifice plate is attached to the underside of the piezoelectric element, the liquid which is not ejected and accumulates in a well which is formed by the central opening of the piezoelectric actuator element and the underlying plate. Eventually this accumulated liquid builds up to a degree such that it damps the pumping action and decreases the output of atomized liquid particles.

The use of drain holes and reflux channels to drain excess ink from nozzle plates is described in U.S. Pat. No. 4,542,389 and U.S. Pat. No. 4,413,268. However, these nozzle plates neither vibrate nor do they convert radial actuator movements to up and down vibratory movements of a perforated orifice plate. Moreover, a wick is not used to transfer liquid to these nozzle plates.

SUMMARY OF THE INVENTION

In one aspect the present invention involves a novel atomizing device which comprises a generally horizontally extending plate having an elevated region adjacent a lower region and formed with at least one atomizing orifice in the elevated region and at least one drain opening in the lower region. The drain opening is substantially larger than the atomizing orifice and permits liquid to flow freely therethrough. The atomizing device also includes a vibration actuator which is connected to vibrate the plate up and down as well as a liquid conductor which is arranged to conduct liquid from a reservoir to the underside of the elevated region of the plate. The liquid which is not ejected from the atomizing orifices in the elevated region or which falls back on the plate flows down to the lower region and through the drain opening.

In another aspect, this invention is based on the discovery that by providing one or more openings in the vibrating plate in a region away from the atomizing orifices, but. over the upper end of the wick or other capillary type liquid conductor means, the liquid which passes down through the openings will tend to saturate the upper end of the liquid conductor means and diminish its drawing power. As a result, the liquid conductor means will stop drawing further liquid from the reservoir and will instead direct the liquid which has passed through the openings back up under the atomizing orifices in the central region of the vibrating orifice plate. This recycled liquid is re-pumped through the atomizing orifices by the continued up and down vibration of the plate and is ejected from the upper surface of the plate.

As the recycled liquid is atomized, the upper end of the wick or liquid conductor means becomes less saturated and it is thereby enabled to draw additional liquid up from the reservoir.

According to this aspect of the invention, a plate having at least one atomizing orifice is caused to vibrate while a liquid is supplied via a capillary type liquid conductor element, such as a wick, which extends from a liquid reservoir. The capillary action of the liquid conductor element causes liquid to be drawn from the reservoir and supplied to the lower side of the plate in the region of the orifice. The vibration of the plate causes the liquid to be pumped through the orifice and ejected from the other side of the plate in the form of aerosolized liquid particles.

The plate is also formed, in a region displaced from the atomizing orifice, with at least one larger opening through which liquid which had not been ejected from the plate or which falls back on the plate can freely flow. This larger opening is located in a position such that it directs the liquid which flows through it to the upper end of the liquid conductor element where it comes into capillary communication with the atomizing orifice on the under side of the plate. This nonejected liquid or liquid which has fallen back on the plate tends to saturate the upper end of the liquid conductor element such that it diminishes the ability of the element to draw additional liquid from the reservoir. As a result, the liquid conductor element draws less or no liquid from the reservoir and instead, by means of capillary action, directs the liquid which has passed through the openings back under the atomizing orifice in the vibrating orifice plate. This recycled liquid is re-pumped through the atomizing orifice by the vibration of the plate and is ejected from the upper surface of the plate in the form of finely divided liquid particles.

The returned liquid which is directed by the liquid conductor element tends to increase the saturation of the element and thereby restricts the element's ability to supply additional liquid from the reservoir, at least until the returned liquid has been re-atomized. This provides an automatic regulation effect on the liquid conductor element, which prevents flooding and waste of the liquid being atomized.

According to a further aspect of the invention there is provided a novel method of atomizing a liquid. This novel method comprises the steps of providing an orifice plate having at least one atomizing orifice, vibrating the plate, at least in the region of the atomizing orifice, while delivering a liquid by capillary action through a capillary type liquid conductor element extending from a liquid reservoir to a location adjacent the atomizing orifice on one side of the plate. The liquid is caused to be pumped through the atomizing orifice and ejected from the other side of the plate in the form of aerosolized liquid particles by the vibration of the plate. The liquid which has not been ejected from the plate, or which falls back on the plate, is directed to flow back down through at least one larger opening in the plate at a location displaced from the atomizing orifice. This non-ejected liquid is conveyed by capillary action back to the atomizing orifice on the one side of the plate for further atomization. Also, this non-ejected liquid acts on the liquid conductor element in a manner to restrict its ability to draw additional liquid from the reservoir until the non-ejected liquid is again pumped through the orifice and ejected from the plate.

DETAILED DESCRIPTION OF A PREFERRED EMBODIMENT

Figure 1:
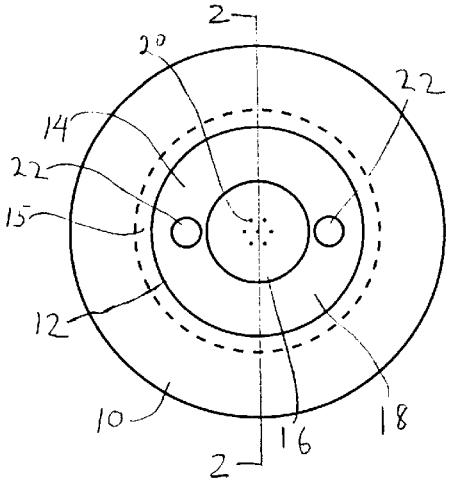
FIG. 1 is a plan view showing a vibrator atomizing device according to one embodiment of the invention.

The vibratory atomizing device of FIG. 1 comprises an annularly shaped piezoelectric actuator element 10 having an inner diameter center hole 12 and an orifice plate 14 which extends across the inner diameter hole 12 on the underside of the actuator and slightly overlaps an inner region 15 of the actuator. The orifice plate 14 is fixed to the underside of the actuator 10 in the overlap region 15. Any suitable cementing means may be used to fix the orifice plate 14 to the piezoelectric actuator element 10; however, in cases where the device may be used to atomize liquids which are corrosive, or aggressive in that they tend to soften certain cements, it is preferred that the orifice plate be soldered to the piezoelectric element. Also, the outer diameter of the orifice plate 14 may be as large as the outer diameter of the actuator element 10 so that it extends over the entire surface of one side of the actuator element. It should be understood that this invention also includes a construction wherein the orifice plate 14 is affixed to the upper side of the actuator 10.

The piezoelectric actuator element 10 may be made from any material having piezoelectric properties which cause it to change dimensionally in a direction perpendicular to the direction of an applied electric field. Thus, in the illustrated embodiment, the piezoelectric actuator element 10 should expand and contract in a radial direction when an alternating electrical field is applied across its upper and lower surfaces. The piezoelectric actuator element 10 may, for example, be a ceramic material made from a lead zirconate titanate (PZT) or lead metaniobate (PN). In the embodiment illustrated herein, the piezoelectric actuator element has an outer diameter of about 0.382 inches and a thickness of about 0.025 inches. The size of the center hole inner diameter is about 0.177 inches. These dimensions are not critical and they are given only by way of example. The actuator element 10 is coated with an electrically conductive coating such as silver, nickel or aluminum to permit soldering of the orifice plate and electrical leads and to permit electric fields from the leads to be applied cross the actuator element.

The orifice plate 14 in the illustrated embodiment is about 0.250 inches in diameter and has a thickness of about 0.002 inches. The orifice plate 14 is formed with a slightly domed center region 16 and a surrounding flange region 18 which extends between the domed center region 16 and the region where the orifice plate is affixed to the actuator 10. The domed center region 16 has a diameter of about 0.103 inches and it extends out of the plane of the orifice plate by about 0.0065 inches. The domed center region contains several (for example 85) small orifices 20 which have a diameter of about 0.000236 inches and which are spaced from each other by about 0.005 inches. A pair of diametrically opposed larger holes 22 are formed in the flange region 18. These holes have a diameter of about 0.029 inches and they allow liquid to flow freely therethrough. Again, the dimensions given herein are not critical and only serve to illustrate a particular embodiment. It should also be noted that while an domed orifice plate is described herein, orifice plates of other configurations may be employed, for example, orifice plates with shapes that resemble a convoluted or corrugated diaphragm.

It will be noted that the doming of the center region 16, which contains the orifices 20, increases its up and down movement of this region so as to improve the pumping and atomizing action of the orifice plate. While the domed center region is spherical in configuration, other configurations in this region may be used. For example, the center region 16 may have a parabolic or arcuate shape. Means other than doming may be used to stiffen the center region 16. For example, a support with spaced thickened elements, as shown in U.S. Pat. No. 5,152,456 may be used.

The orifice plate 14 is preferably made by electroforming with the orifices 20 and the holes 22 being formed in the electroforming process. However, the orifice plate may be made by other processes such as rolling; and the orifices and holes may be formed separately. For ease in manufacture, the center region 16 is domed after the orifices 20 have been formed in the orifice plate.

The orifice plate 14 is preferably made of nickel, although other materials may be used, provided that they have sufficient strength and flexibility to maintain the shape of the orifice plate while being subjected to flexing forces. Nickel-cobalt and nickel-palladium alloys may also be used.

The piezoelectric actuator element 10 may be supported in any suitable way which will hold it in a given position and yet not interfere with its vibration. Thus, the actuator element may be supported in a grommet type mounting (not shown).

Figure 2:
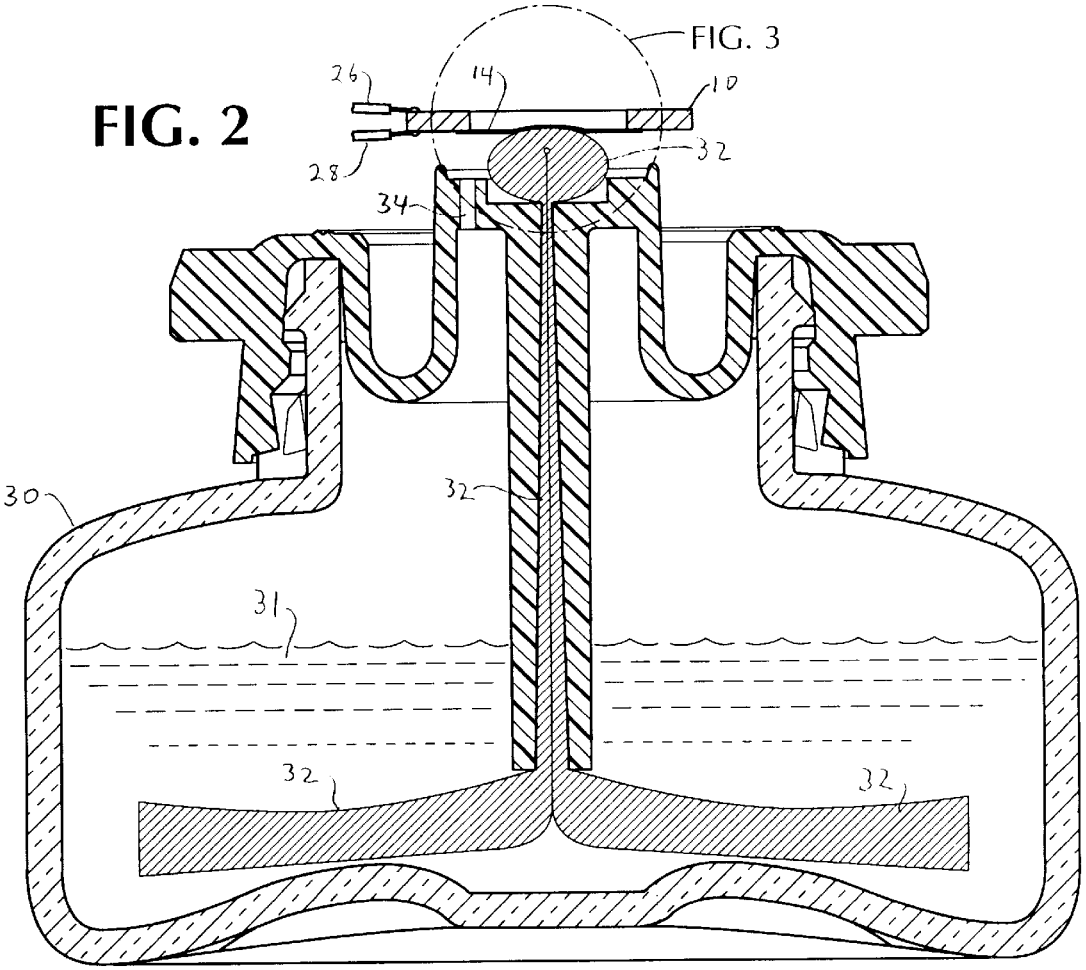
FIG. 2 is a section view taken along line 2—2 of FIG. 1.

The piezoelectric actuator element 10 is coated on its upper and lower surfaces with an electrically conductive coating such as silver, aluminum or nickel. As shown in FIG. 2, electrical leads 26 and 28 are soldered to the electrically conductive coatings on the upper and lower surfaces of the actuator element 10. these leads extend from a source of alternating voltages (not shown).

Figure 3:
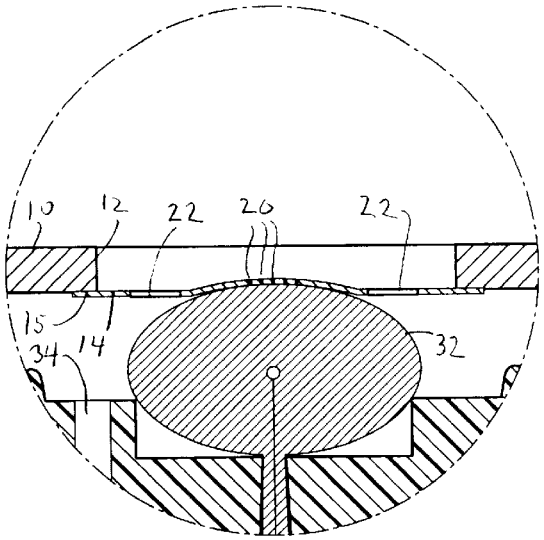
FIG. 3 is an enlarged fragmentary view of the region identified as FIG. 3 in FIG. 2.

A liquid reservoir 30, which contains a liquid 31 to be atomized, is mounted below the actuator element 10 and the orifice plate 14. A wick 32 extends up from within the reservoir to the underside of the orifice plate 14 so that its upper end (where it is looped over and projects up from the reservoir) lightly touches the orifice plate in the center region 16 at the orifices 20. The upper end of the wick 32 also extends laterally so that it is directly under and is in direct liquid communication with the larger holes 22, as shown in FIG. 3. Actually, the wick could be annular and of a diameter larger than the domed center region 16 so that it contacts only the flange region 18 of the orifice plate.

The wick 32 may be made of a porous flexible material which provides good capillary action to the liquid in the reservoir 30 so as to cause the liquid to be pulled up to the underside of the membrane 14. At the same time the wick should be sufficiently flexible that it does not exert pressure against the orifice plate 14 which would interfere with its vibratory motion. Subject to these conditions, the wick 32 may be made of any of several materials, for example, paper, nylon, cotton, polypropylene, fibreglass, etc. A preferred form of wick 32 is strand of nylon chenille yarn that is looped back on itself where it touches the orifice plate. This causes very thin fibers of the strand to extend up to the plate surface. These very thin fibers are capable of producing capillary action so as to bring liquid up to the orifice plate; however, these thin fibers do not exert any appreciable force on the plate which would interfere with its vibratory movement.

The portion of the upper end of the wick 32 which extends under the orifice plate 14 between the larger holes 22 and the orifices 20 places the holes and orifices in capillary communication with each other along the underside of the plate. The effect of this arrangement will be discussed hereinafter.

It will be appreciated that liquid conductor means other than a wick may be employed and the use of the word "wick" herein is intended to include such other capillary type liquid conductor means.

In operation of the atomizer, the wick 32 or other liquid conductor means, by means of capillary action, draws liquid 31 up from the reservoir 30 and into contact with the orifice plate 14 in the region of the atomizing orifices 20.

At the same time, alternating electrical voltages from an external source are applied through the leads 26 and 28 to the electrically conductive coatings on the upper and lower surfaces of the actuator element 10. This produces a piezoelectric effect in the material of the actuator element whereby the material expands and contracts in radial directions. As a result, the diameter of the center hole 12 increases and decreases in accordance with these alternating voltages. These changes in diameter are applied as radial forces on the orifice plate 14 and pushes its domed center region 16 up and down. This produces a pumping action on the liquid which was drawn up against the underside plate 14 by the wick 32. The capillary action of the wick maintains the liquid on the underside of the orifice plate 14; and as a result, the liquid 31 is forced upwardly through the orifices 20 by the vibration of the plate and is ejected from the upper surface of the plate as finely divided aerosolized liquid particles into the atmosphere.

Not all of the liquid which is pumped through the orifices 20 is ejected; and a small amount of the liquid remains on the upper surface of the orifice plate. This non-ejected liquid flows down the sides of the domed center region 16 and into the region surrounded by the actuator center hole 12. As a result, liquid tends to build up on the flange region 18 of the orifice plate 14 and interferes with its flexing and pumping action.

The present invention overcomes this problem by directing the non-ejected liquid down through the larger holes 22 and onto the upper end of the wick 32, which as mentioned previously, extends laterally under these larger holes. The wick in turn places this non- ejected liquid into capillary communication, along the under side of the orifice plate 14, with the atomizing orifices 20. As a result this liquid is drawn back to the orifices 20 and is pumped back through them by the vibratory movement of the orifice plate 14 for ejection in the form of finely divided liquid particles from the upper side of the plate.

The liquid which passes down through the larger holes 22 tends to increase the saturation of the upper end of the wick 32 and restricts the ability of the wick to draw additional liquid up from the reservoir 30, at least until the liquid from the larger holes has been repumped back up through the atomizing orifices 20. At this point the upper end of the wick becomes unsaturated so that the wick can then draw additional liquid up from the reservoir.

It will be appreciated that the above described arrangement provides a self regulating effect which prevents flooding in the upper region of the reservoir 30. This is important to preventing leakage and loss of liquid from the atomizer device. Also, in order for the liquid to be effectively drawn up from the reservoir 30, the reservoir is provided with a vent opening 34 in its upper region. Because the non-ejected liquid is directed along the underside of the orifice plate 14, it is prevented from coming into contact with, and causing plugging of, the vent opening 34.

Industrial Applicability

The atomizer device of this invention permits liquid from a reservoir to be atomized effectively and continuously without a buildup of liquid on the atomizing element. The invention also permits the liquid which has not been ejected from the atomizer to be recycled back through the atomizer device without spilling or waste. The means by which this is accomplished is simple and economical to carry out.

What is claimed is:

1. An atomizing device comprising:

a generally horizontally extending plate having an elevated region adjacent a lower region, said elevated region having an upper side and an underside said plate being formed with at least one atomizing orifice extending therethrough in said elevated region and at least one drain opening extending therethrough in said lower region, said at least one drain opening being substantially larger than said at least one atomizing orifice for permitting liquid to flow freely therethrough;

a vibration actuator connected to vibrate said plate up and down; and a liquid conductor arranged to conduct liquid from a reservoir to said underside of said elevated region of said plate.

2. An atomizing device according to claim 1 wherein a plurality of atomizing orifices extend through said elevated region.

3. An atomizing device according to claim 2 wherein said elevated region is domed and said lower region surrounds said elevated region.

4. An atomizing device according to claim 3 wherein said vibration actuator is an annularly shaped piezoelectric element which is energized to expand and contract in radial directions in response to alternating voltages applied to upper and lower sides thereof; and wherein said plate extends across a central opening in said pioezoelectric element and is fixed at the periphery of said lower region to said piezoelectric element around its central opening, whereby the radial expansion and contraction of said piezoelectric element causes said elevated region to move up and down.

5. An atomizing device comprising:

a plate having at least one atomizing orifice;

a vibration actuator connected to said plate to cause said plate to vibrate;

a liquid reservoir;

a capillary type liquid conductor element extending from within said reservoir, an upper end of said liquid conductor element being adjacent said at least one atomizing orifice on one side of said plate whereby said liquid conductor element draws liquid from said reservoir by capillary action into communication with said at least one atomizing orifice such that the liquid becomes pumped through said at least one atomizing orifice by vibration of said plate and ejected in the form of finely divided liquid particles from the opposite side of said plate;

said plate being formed, in a region displaced from said at least one atomizing orifice, with at least one opening which is larger than said at least one atomizing orifice and through which liquid which had not been thrown off from said opposite side of said plate can freely flow, said at least one larger opening being located in a position such that it directs the liquid which flows through it onto the upper end of the liquid conductor element and into capillary communication along one side of said plate with said at least one atomizing orifice for pumping back through said at least one atomizing orifice and ejection from an opposite other side of said plate in the form of finely divided liquid particles.

6. An atomizing device according to claim 5, wherein said plate extends in a generally horizontal direction and wherein said plate is formed with an elevated region which contains said at least one atomizing orifice, said region displaced from the at least one atomizing orifice constituting a lower region which contains said at least one larger opening.

7. An atomizing device according to claim 5, wherein said plate contains a plurality of atomizing orifices.

8. An atomizing device according to claim 5, wherein said plate contains at least two of said larger openings displaced from each other.

9. An atomizing device according to claim 8, wherein said openings are displaced diametrically from each other.

10. An atomizing device according to claim 5, wherein said upper end of said capillary type liquid conductor element extends under both said at least one atomizing orifice and said larger opening.

11. An atomizing device according to claim 5, wherein said capillary type liquid conductor element is a wick.

12. An atomizing device according to claim 5, wherein said vibration inducing actuator is an annular piezoelectric actuating element having a center hole and wherein said plate extends across said center hole.

13. An atomizing device according to claim 5, wherein said plate is formed with a dome in a center region thereof and wherein said at least one atomizing orifice is formed in said dome.

14. An atomizing device according to claim 13, wherein said at least one larger opening is formed in said plate adjacent said dome.

15. A method for atomizing al liquid comprising the steps of:

providing an orifice plate having at least one atomizing orifice;

vibrating the plate, at least in the region of said at least one atomizing orifice, while delivering a liquid by capillary action through a capillary type liquid conductor element extending from a liquid reservoir to a location adjacent said at least one atomizing orifice on one side of the plate;

causing the liquid to be pumped through said at least one atomizing orifice and ejected from the other side of the plate in the form of finely divided particles by the vibration of the plate;

directing the liquid which has not been ejected from the plate to flow back down through at least one opening in the plate which is larger than said at least one atomizing orifice and which is at a location displaced from said at least one atomizing orifice and onto the capillary type liquid conductor so that it can be conveyed by capillary action on said one side of said plate back to the at least one atomizing orifice for further atomization.

16. A method according to claim 15, wherein said plate is held to extend in a generally horizontal direction and wherein liquid which is not ejected from said plate is caused to flow toward said at least one larger opening.

17. A method to claim 15, wherein a plurality of atomizing orifices are provided in said plate.

18. A method according to claim 15, wherein at least two of said larger openings are provided in said plate at locations which are displaced from each other.

19. A method according to claim 18, wherein said openings are displaced diametrically from each other.

20. A method according to claim 15, wherein the upper end of said capillary type liquid conductor element is provided to extend under both said at least one atomizing orifice and said larger opening.

21. A method according to claim 15, wherein a wick is provided as said capillary type liquid conductor element.

22. A method according to claim 15, wherein said plate is vibrated by means of an annular piezoelectric actuating element having a center hole and wherein said plate extends across said center hole.

23. A method according to claim 15, wherein said plate is formed with a dome in a center region thereof and wherein said at least one atomizing orifice is formed in said dome.

24. A method according to claim 23, wherein said at least one larger opening is formed in said plate adjacent said dome.

* * * * *

UNITED STATES PATENT AND TRADEMARK OFFICE

CERTIFICATE OF CORRECTION

PATENT NO. : 6,341,732 B1 
DATED : January 29, 2001
INVENTOR(S) : Frederick H. Martin, Thomas A. Helf, David J. Schram, Maryann Jashinske, David A. Tomkins and Edward J. Martens, III It is certified that error appears in the above-identified patent and that said Letters Patent is hereby corrected as shown below:

Title page,
Item [57], ABSTRACT,
Last line, change "reputing" to -- repumping --.

Column 2,
Line 57, replace "nonejected" with -- non-ejected --.

Column 8,
Line 8, replace "atomizing al" with -- atomizing a --.

Signed and Sealed this

Eleventh Day of June, 2002

*Attest:*

*Attesting Officer*

JAMES E. ROGAN
*Director of the United States Patent and Trademark Office*